US005730196A

United States Patent [19]

Frament

[11] Patent Number: 5,730,196

[45] Date of Patent: Mar. 24, 1998

[54] COMBINATION ORNAMENT AND SAFETY DEVICE FOR ATTACHMENT TO SCREENS

[76] Inventor: Gavin A. Frament, 143 Whipple Ave., Warwick, R.I. 02889-4726

[21] Appl. No.: 537,535

[22] Filed: Oct. 2, 1995

[51] Int. Cl.[6] ..... E06B 3/32

[52] U.S. Cl. ..... 160/90; 160/10; 40/668; 248/303

[58] Field of Search ..... 160/10, 237, 404, 160/90; 16/1 R; 245/1, 2; 40/658, 666, 668, 664, 308, 597; 248/221.31, 303

[56] References Cited

U.S. PATENT DOCUMENTS

| | | | |
|---|---|---|---|
| 1,764,398 | 6/1930 | Fitzgerald | 160/237 X |
| 2,283,803 | 5/1942 | Gittens | 245/2 |
| 2,521,927 | 9/1950 | Magidson | 40/664 |
| 2,636,298 | 4/1953 | Macklanburg . | |
| 3,261,393 | 7/1966 | Templeton . | |
| 3,308,875 | 3/1967 | Abrams | 160/237 X |
| 3,409,260 | 11/1968 | Bleed | 248/220.31 X |
| 4,163,817 | 8/1979 | DiCarlantonio et al. . | |
| 4,222,162 | 9/1980 | Levy et al. . | |
| 4,760,980 | 8/1988 | Sharpe . | |
| 4,953,817 | 9/1990 | Mosteller | 248/303 X |
| 5,582,377 | 12/1996 | Quesada | 248/303 X |

*Primary Examiner*—Blair Johnson
*Attorney, Agent, or Firm*—Robert J. Doherty

[57] ABSTRACT

A device for attachment to screens including a body in turn having arms by which the device is attached to the screen and legs by which the device is stabilized in position. The body preferably includes an element such as a hook such that an ornament may be suspended from the device so that the device serves as a visual warning so that people will be aware of its presence.

8 Claims, 8 Drawing Sheets

COMBINATION ORNAMENT AND SAFETY DEVICE FOR ATTACHMENT TO SCREENS

BACKGROUND AND OBJECTS OF THE INVENTION

This invention is directed to a device for attachment to conventional screens of the type having an open mesh structure whether composed of metal or cloth and more particularly to such screens which form a portion of sliding glass doors. It is generally known that decorative elements may be fastened to the surface of such glass doors such that the users thereof will immediately recognize that the door is closed when such is the case and not walk into or even through such doors. The sliding screen door which forms a component of such overall assemblies presents a similar problem and occasionally absent minded people or those otherwise distracted have been known to walk through or into such screen doors. In that regard while it is known to place decorative panels upon such screens or even provide screen repair in the form of decorative elements, the concept of addressing this specific problem by the supplying of an appropriate device for that purpose has not been accomplished. Accordingly, there remains a need for a device which can be placed upon a screen and particularly such sliding screen doors and further serve as either a decorative element itself or as a base for such a decorative element so that people will more quickly observe the fact that the screen door is in a closed position.

Examples of prior U.S. patents which show the general concept of patching a screen through the attachment of an ornamental device thereto are shown in the following U.S. patents: U.S. Pat. No. 4,760,980 to Sharpe issued Aug. 2, 1988; U.S. Pat. No. 4,222,162 to Levy et al issued Sep. 16, 1980; U.S. Pat. No. 4,163,817 to Dicarlantonio et al issued Aug. 7, 1979; and U.S. Pat. No. 3,261,393 to Templeton issued Jul. 19, 1966. Other examples of the manner in which a decorative panel or element may be attached to a screen-like member are shown in U.S. Pat. No. 2,636,298 to Macklanburg issued Apr. 28, 1953 and U.S. Pat. No. 3,308,875 to Abrams issued Mar. 14, 1967. A further U.S. patent, namely, U.S. Pat. No. 405,851, to Schlyer issued Jun. 25, 1889 utilizes presumably shiny metal tags or signals which are directly attached to strands of barbed wire as a signal device and U.S. Pat. No. 4,788,745 to Wallis et al issued Dec. 6, 1988 which shows the manner in which a handle may be attached to a screen.

Despite the existence of such above indicated material, the need as previously mentioned still exists for a device which can be easily and quickly attached and removed from a screen door or the like and which serves as a signal device in a convenient and straightforward manner. Accordingly, the above and further objects of the present invention are accomplished by the provision of a device for attachment to a screen of the type having a plurality of mesh-like openings, said device including a generally centrally disposed, non-mesh, generally solid body having opposed front and rear faces, means for attaching said device to said screen comprising at least one arm attached to said body and upwardly extending from said body, said arm upwardly terminating in finger means for extension through an opening of said screen, said device further having at least one leg attached to said body and downwardly extending from said body, said leg terminating in foot means for contacting said screen to stabilize said body on said screen and an ornament supporting means connected to said body for suspending or otherwise supporting an ornament from said body such that said ornament may be forwardly spaced from said screen.

Other objects, features and advantages of the invention shall become apparent as the description thereof proceeds when considered in connection with the accompanying illustrative drawings.

DESCRIPTION OF THE DRAWINGS

In the drawings which illustrate the best mode presently contemplated for carrying out the present invention.

DETAILED DESCRIPTION OF THE INVENTION

Figure 1:
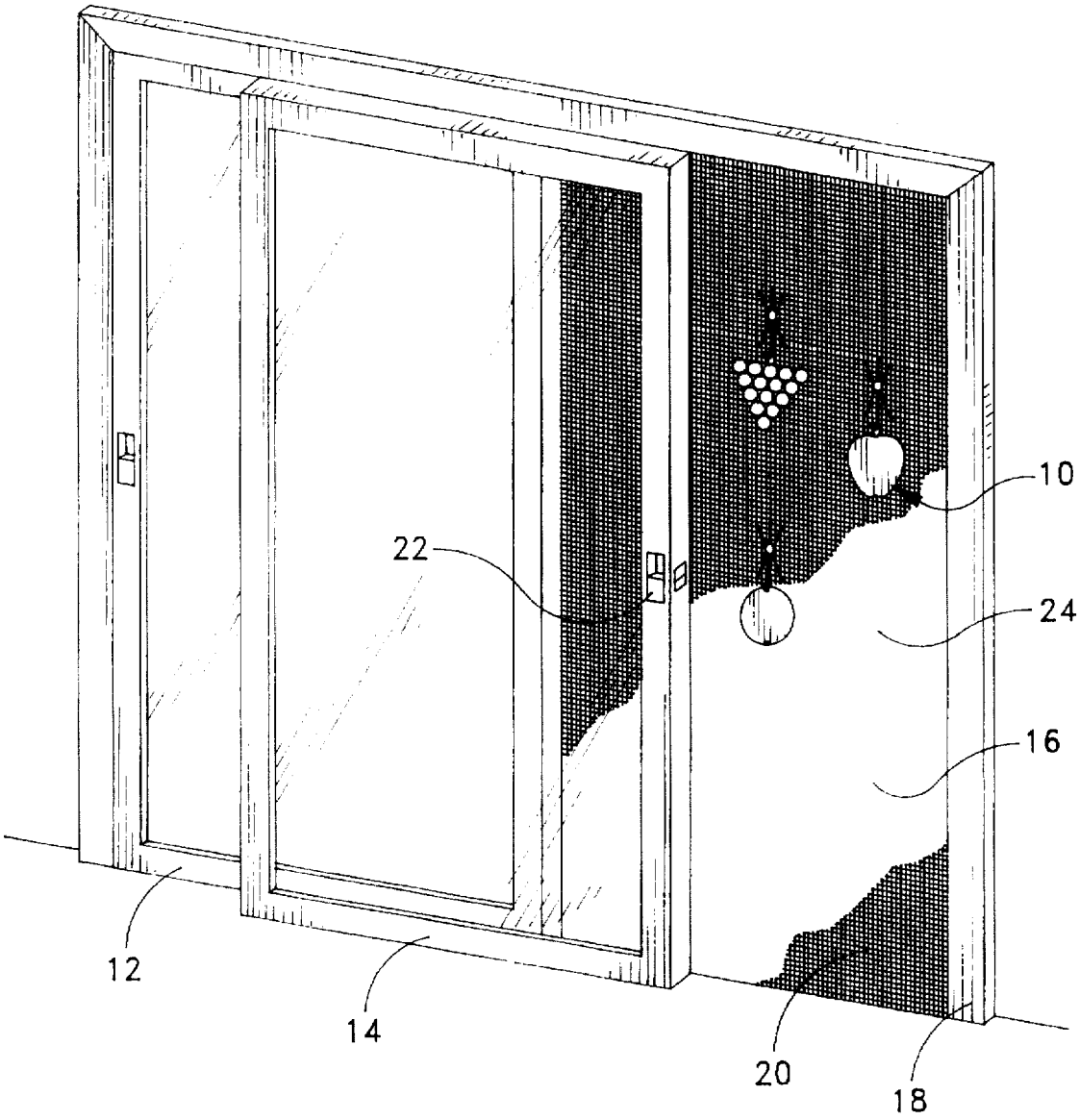
FIG. 1 shows a front perspective view of a sliding door assembly including a sliding screen on which several of the devices of the present invention are attached.

Turning now to the drawings and particularly FIGS. 1 through 5 thereof, the device 10 of the present invention as well as its use environment is shown. FIG. 1 is a front perspective view taken from the inside of the house or other building of a standard three-part sliding door unit on which the device 10 of the present invention is shown suspended from the screen portion thereof. Such units typically include a fixed door 12, a sliding door 14 and a sliding screen 16. The sliding portions thereof move laterally back and forth within tracks (not shown) and the entire assemblage is mounted within a standard frame structure 18. Typically the track on which the screen 16 is mounted is positioned on the outside of the unit 12—it being clear that such unit is viewed from the inside in FIG. 1. Also in order to keep the thickness of the unit within reason, clearance between the screen 20 itself and the frame in which it is held for purposes of being able to slide back and forth is minimal, that is, on the order of one half (½) inch so that adequate clearance of the outer shown in FIGS. 2 through 5 that such includes a generally centrally positioned body 40. The body 40 may be formed from any suitable material but is preferably solid such as wood, metal or plastic and includes opposed front and rear surfaces 42 and 44 respectively and is of overall slender configuration, that is, minimal thickness. It should also be apparent that the body 40 may take any geometric configuration such as the circular disc shape depicted. Also, the front surface could include an image, design, picture or the like, e.g., a cartoon character, and such image could be three dimensional as well, that is, forwardly projecting from the body at least to an extent that does not operationally exceed the sliding door clearance as previously mentioned. It is also preferable that the body 40 be lightweight and in some cases capable of being machined such that supporting arms and legs extending outwardly therefrom may be inserted into holes formed in the body of alternatively such arms and legs or other appendages may be integrally formed with the body 40 or some combination of the above including the formation surface of the fixed door 12 as well as the actuating hardware 22 on the sliding door 14 is present. Accordingly, the front to rear overall thickness of the device or devices 10 mounted on the screen should be within such minimal clearance, that is, slightly less than the clearance between the outside of the fixed door 12 and the inner surface 24 of the screen 20. Obviously if the devices 10 were mounted on the opposed outer surface 26 of the screen 20, such thickness restriction would not be a major consideration. However, it is most likely and more desirable for reasons which will be hereinafter apparent that the device or devices 10 be mounted to the inner surface 24 of the screen 20. Such screen 20 may be of any conventional type either constructed of plastic, Fibreglas or metal such as aluminum or copper in which parallel sets of vertically and horizontally oriented material strands 28 are crisscrossed to form open mesh openings 30 therebetween.

Turning now to the overall construction of the device 10 of the present invention, it will be apparent as of the body from a cast resin in which the appendages are embedded or any combination of the above.

Figure 4:
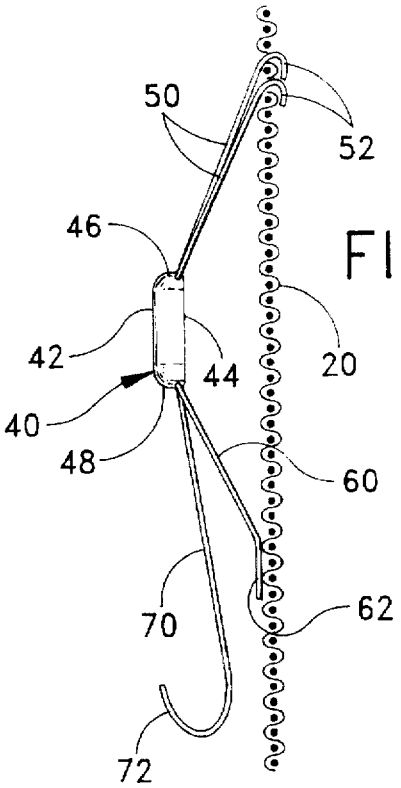
FIG. 4 is a side view taken from the right side of FIG. 3.

At least one and preferably a plurality of arms 50 upwardly and outwardly radially extend from the upper surface 46 of the body 40. Such arms 50 terminate in inwardly or inwardly and downwardly extending fingers 52. Preferably the arms 50 are formed from a thin metal, plastic or other wire-type material of a thickness such that the fingers 52 can easily pass through the screen openings 30 as depicted in FIG. 4 of the drawings. It may be also preferable in some applications that the fingers 52 are bendable or otherwise manipulatable by one's fingers to change their angular relationship with the arms for ease in fitting into the same holes. As above indicated, it is preferably that two or more of the arms 50 be present and that they are disposed in a laterally separated configuration at their outer terminal ends such that the weight of the device 10 is distributed to more than one specific area of the screen and that lateral sway and to some extent front to rear sway caused by a combination of wind as well as the back and forth lateral sliding movement of the screen 20 is minimized. It is generally contemplated that the arms 50 be formed from a metal wire material and, as previously indicated, the lower ends 51 of the arms 50 proximate to the body 40 are attached thereto by any suitable method including a forced fit into holes machined or otherwise provided in the body upper surface 46, the embedding of the proximal ends of the arms 50 in the body as in a casting or hardening procedure or the adhesive connection thereto by conventional means such as glue.

Figure 4A:
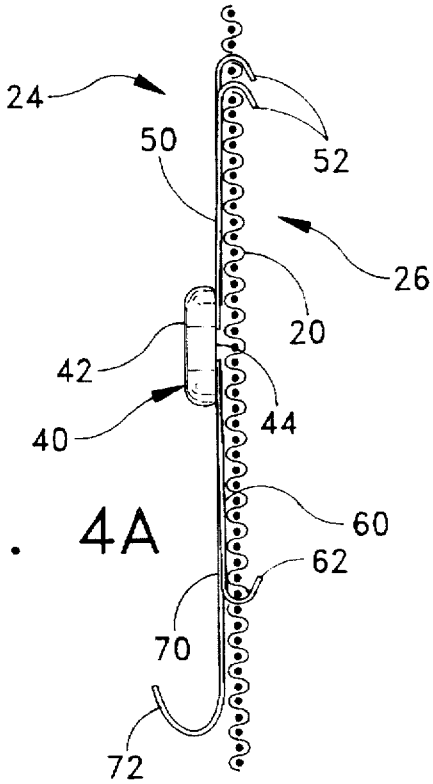
FIG. 4A is a side view similar to FIG. 4 but showing an alternate embodiment.
Figure 5:
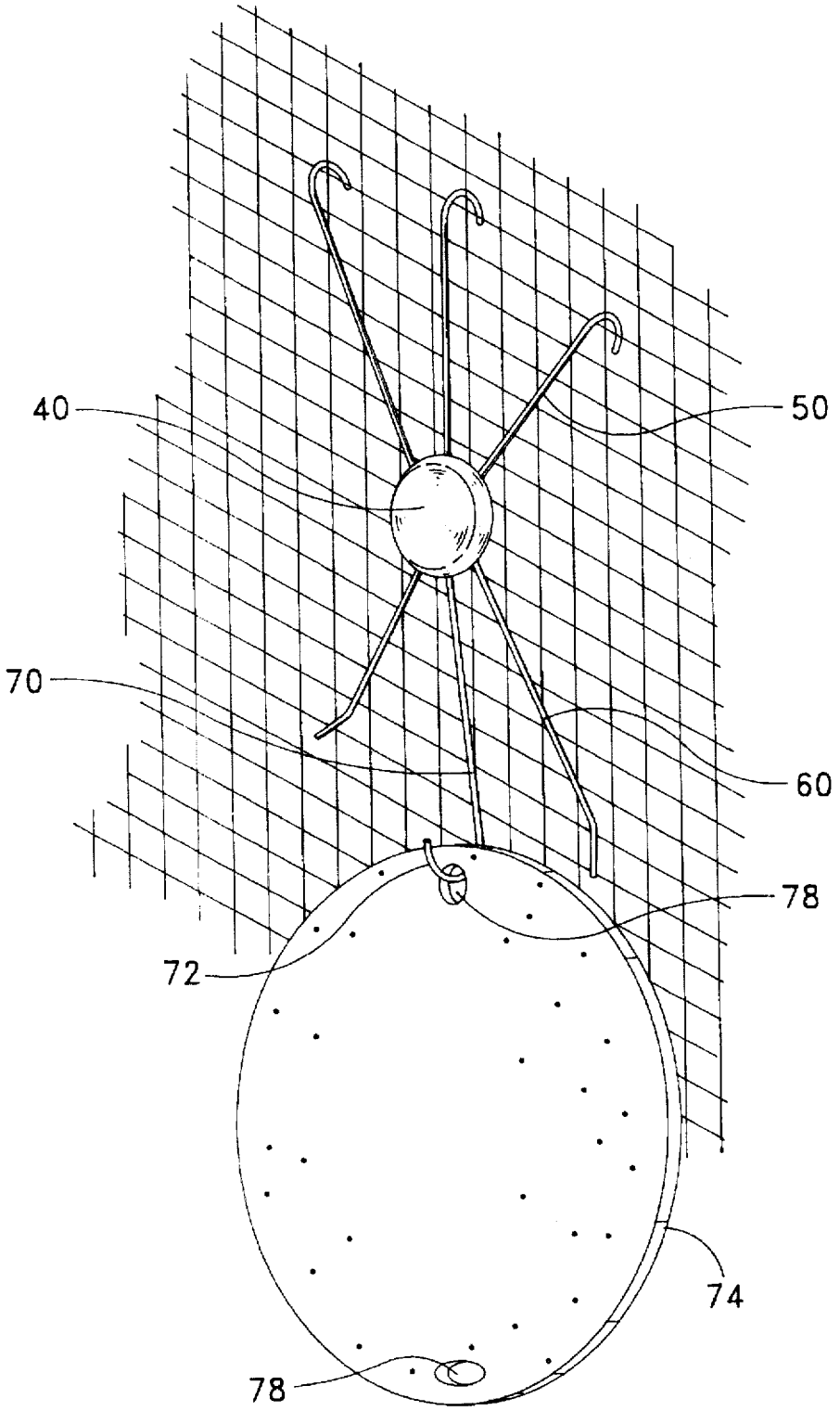
FIG. 5 is a perspective view similar to FIG. 3 but showing the suspension of an added ornament.

Also in order to better stabilize the device 10, the lower body surface 48 is provided with preferably a pair of downwardly and preferably inwardly extending legs 60 which in turn terminate in foot portions 62. The proximate upper ends 64 of the legs 60 are connected to the body 40 similar to the various means by which the arms 50 are connected thereto and the distal ends 66 disposed in a laterally spaced relationship to each other such that desired contact of the feet 62 against the inner surface 24 of the screen 20 further tends to stabilize the position of the device 10 with respect to the screen 20. In addition, it is preferable that both the arms and legs 50 and 60 respectively progressively extend downwardly and outwardly to space the inner surface 44 of the body 40 away from the inner surface 24 of the screen 20 such that the body 40 of the device 10 can be easily manipulated and used when attaching and detaching such from the screen 20 (such spaced relationship allows the user's fingers to better manipulate the device without interference from the screen surface) and for insuring that a downwardly extending support 70 terminating in a hook 72 may also be forwardly spaced from the front surface of the screen which is desirable particularly when the object supported by the hook has some thickness or rearward depth such that such depth can be accommodated. In those cases where the object supported by the hook 72 is essentially flat like the disc 74 depicted, it is sometimes preferable that the support 70 extend downwardly rearwardly so as to be close to or even lightly contact the front of the screen such that the support enables the ornament such as the disc 74 to contact or brush against the face of the screen which position and contact tends to stabilize the ornament in position on the screen when the screen is laterally moved. Such modification is best illustrated in FIG. 4A. FIG. 4A also shows the body in contact or close to the face of the screen to better accommodate narrow clearances in sliding screen door configurations. It is on this hook portion 72 of the support 70 that conventional ornaments such as a disc 76 may be attached. Such ornaments 74 may include conventional ornaments that are utilized for other purposes or especially formulated ornaments for use in conjunction with the device 10 of the present invention. Such ornaments 74 may include those with shiny or reflective surfaces or those including bright colors or other mechanisms to attract one's attention such that the overall safety and ornamental purposes of the present invention are accomplished.

Figure 1A:
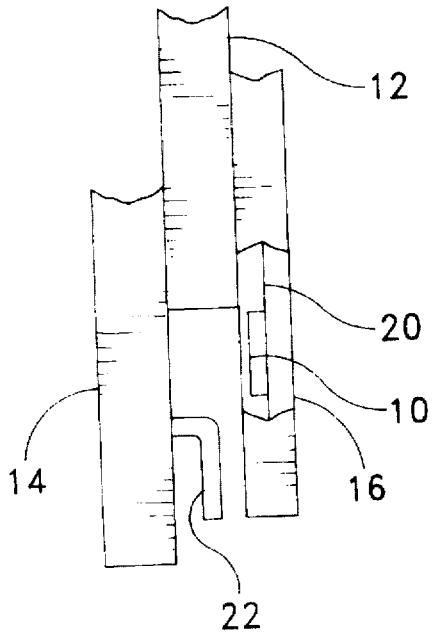
FIG. 1A is a partial top view of FIG. 1 with broken away portions to show the spacing of the doors and particular a device of the present invention in relation to such spacing.
Figure 2:
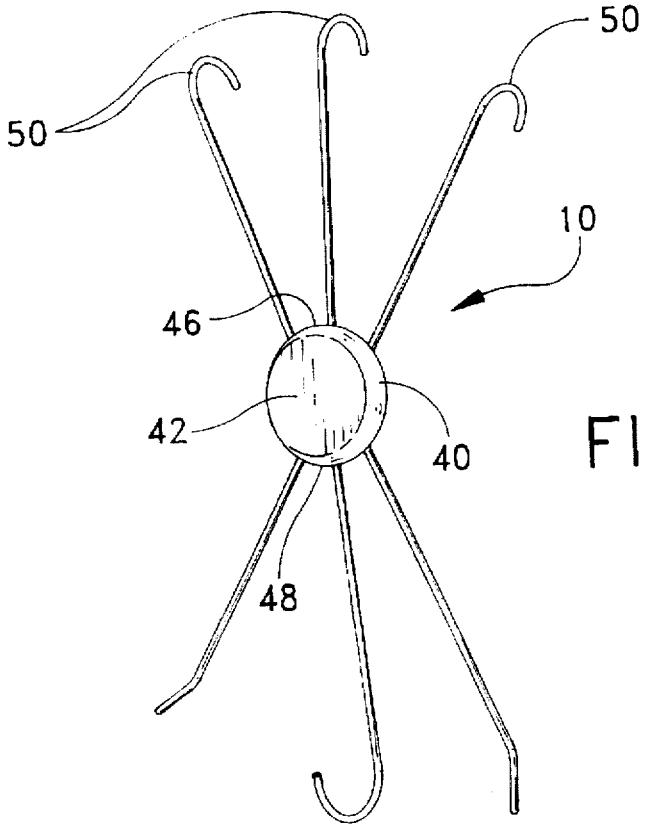
FIG. 2 shows one form of the device of the present invention.
Figure 3:
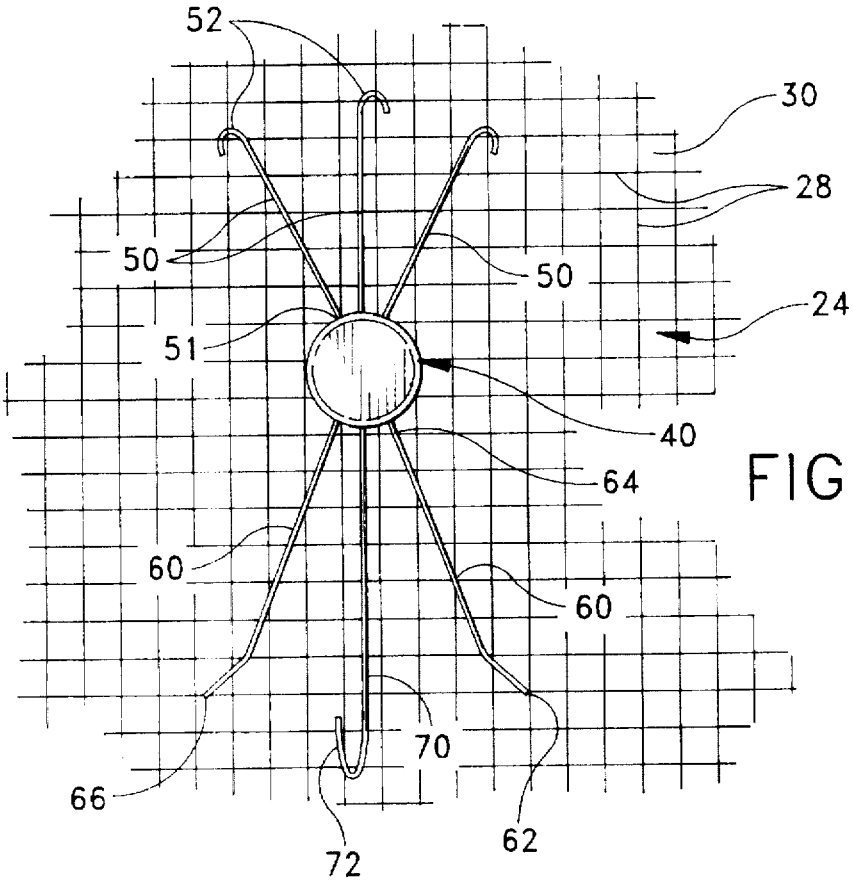
FIG. 3 is a view similar to FIG. 2 but showing the particular manner in which the device shown in FIG. 2 is attached to the screen.

It should also be brought out that the front surface 42 of the body 40 can serve not only an ornamental function if desired but also can serve to form the means by which other ornamental features are supported as will hereinafter be more fully brought out. Generally, the ornament 74 is hung from an opening 78 provided therein and such ornaments 74 are, of course, constructed with minimal front to rear thickness in order to be accommodated in the space between the front surface of the screen 20 and the rear surfaces of the fixed and moving doors 12, 14 respectively (in particular the rear surface of door 12 as best shown in FIG. 1A). It is for such spacing reason that it is also desirable to construct the leg 70 so it downwardly inwardly extends so that the hook 72 is somewhat in line or slightly inwardly spaced from the body such that ornaments which have greater thickness then say discs are positioned so that they can pass by the fixed door 12.

Figure 6:
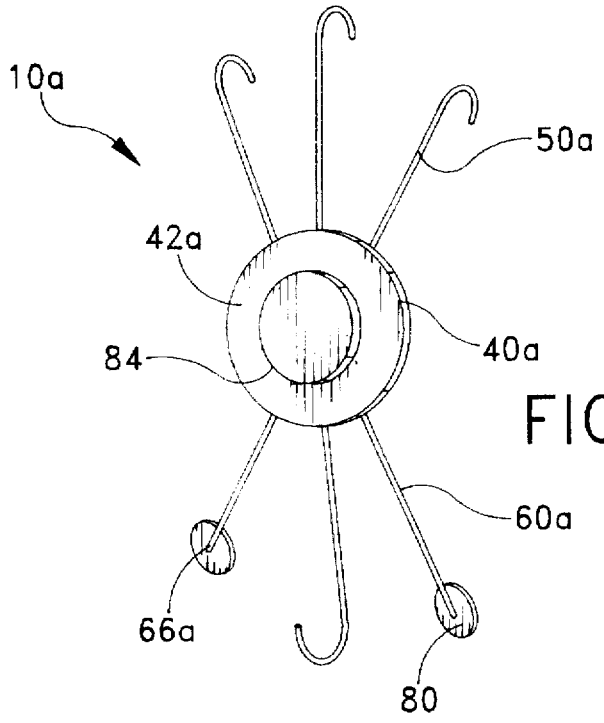
FIG. 6 is a view similar to FIG. 2 but of an alternate embodiment of the invention.
Figure 7:
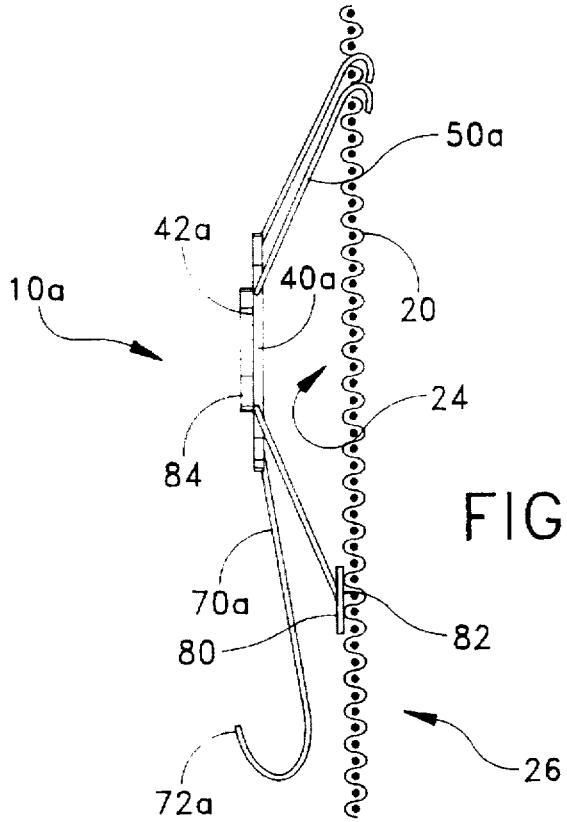
FIG. 7 is a right side elevational view of the device shown in FIG. 6.

Turning now to FIGS. 6 and 7 of the drawings, it will be apparent that such show a modified form of the device **10*a* in which the feet thereof are in the form of thin pads 80 connected to the distal end 66*a* of the legs 60*a*. The rear surface 82 of the pads 80 are adapted to contact the front surface 24 of the screen 20 and in this way provide enhanced frictional contact such that sway in a back and forth lateral direction is minimized. In addition, the front surface 42*a* of the body 40*a* is provided with a secondary disc 84 having a front surface forming one of the two part components of a hook and loop connecting system such as provided by VELCRO fasteners. Such secondary disc 84 may also be glued or otherwise attached to the front surface 42***a*. Ornaments such as the disc 76 shown in FIG. 5 may be attached to the front of the device 10*a* as shown in FIGS. 6 and 7 by providing the alternate component part of the two part loop and hook fastening system to the rear surface of the ornament 74 and then attaching the two surfaces together by attachment pressure.

Figure 8:
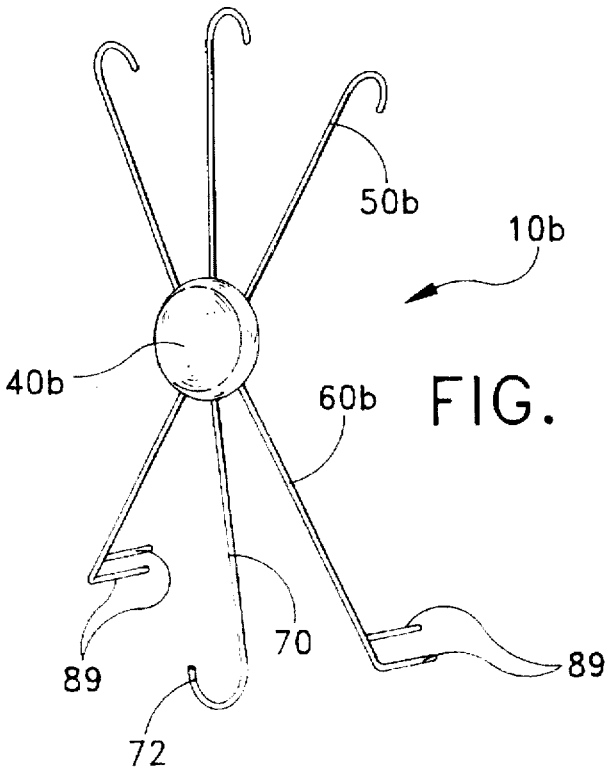
FIG. 8 is a view similar to FIG. 2 but showing a still further embodiment of the present invention.
Figure 9:
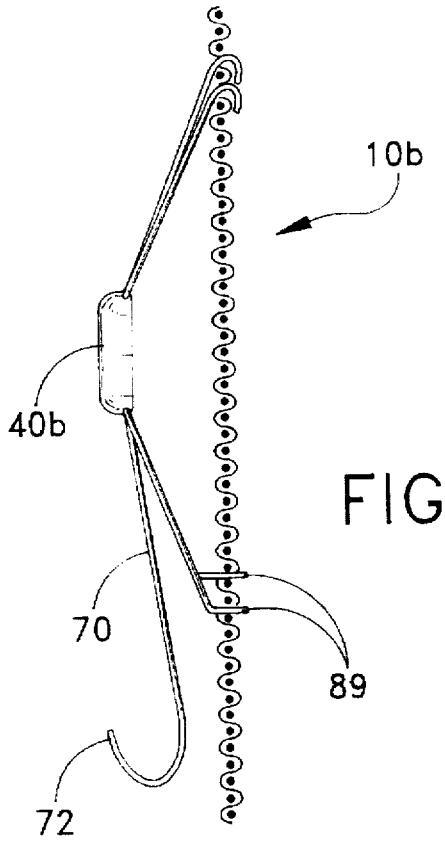
FIG. 9 is a right side elevational view of FIG. 8.

Another modified form of the invention is shown in FIGS. 8 and 9 wherein a device 10*b* is shown with a still further modified form of leg 60*b* in which the feet portion thereof terminate in a pair of rearwardly extending foes 90 adapted to extend into the mesh openings 30 of the screen 20 and thus provide a more positive or enhanced deterrent to lateral sway of the overall device 10*b*. It should also be pointed out that in both the modified forms of the invention as shown in FIGS. 6 through 9, the support terminating in a hook 72 may be utilized in conjunction therewith. Generally, it is also desirable to configure the support 70 such that the hook portion 72 thereof terminates below the legs 60, 60*a* or 60*b* such that the swaying of a connecting string to which an ornament 74 is attached or the ornament itself is less likely to contact the legs.

Figure 10:
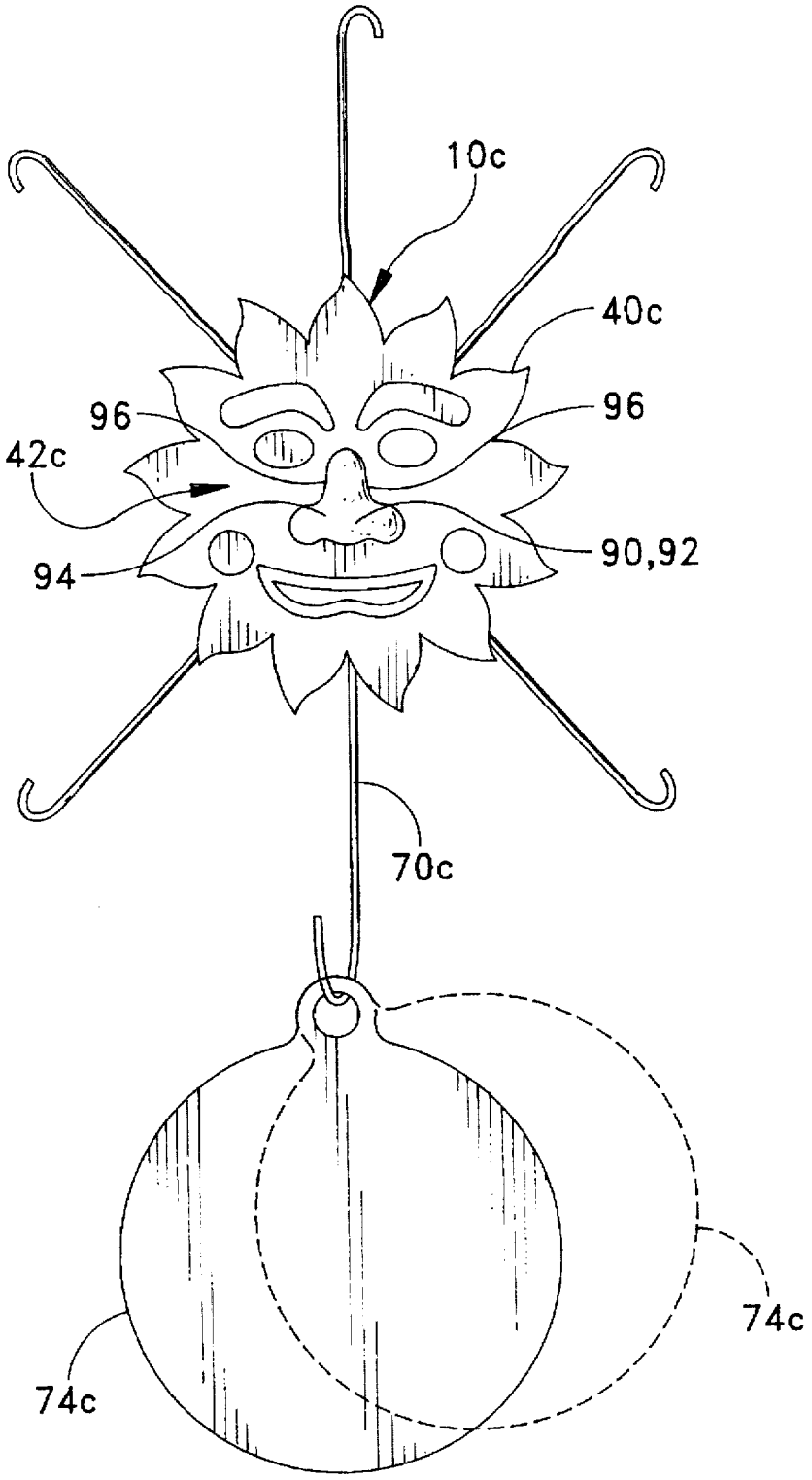
FIG. 10 is a front elevational view of another alternate embodiment.
Figure 11A:
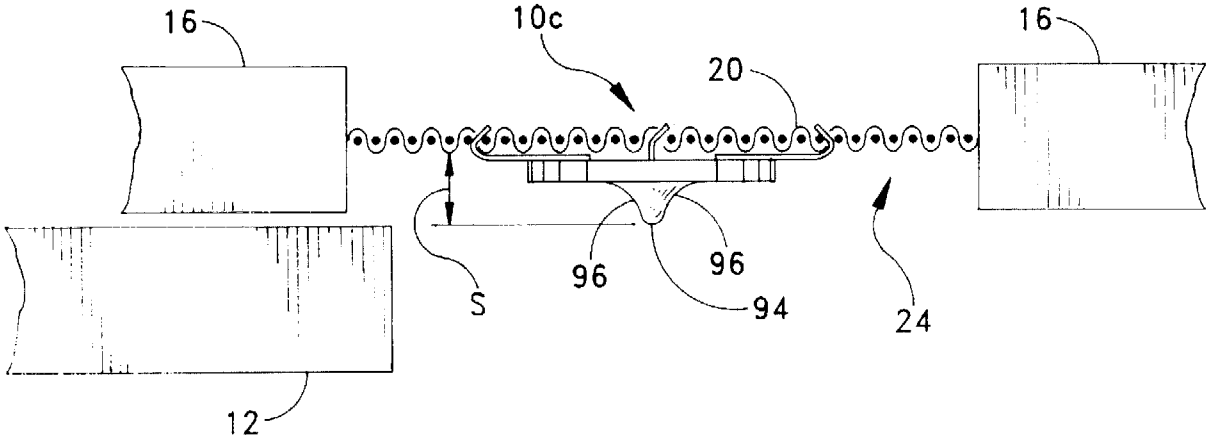
FIGS. 11A and 11B are partial top views similar to FIG. 1 showing the manner in which the device shown in FIG. 10 operates.
Figure 11B:
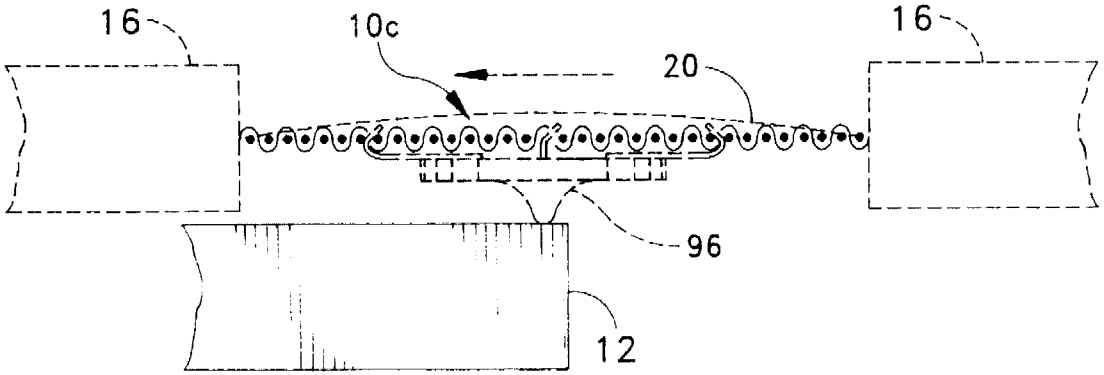

Another modified form of the invention is shown in FIGS. 10 and 11A and 11B wherein a device 10*c* includes a body 40*c* which is of a thickness closely approximating the substantially narrow space S between the face of the screen on which the device is attached and the fixed door 12 or other abutment past which the sliding screen door 16 passes when laterally moved. This space S as previously indicated is on the order of ½ inch and thus the body thickness is generally less than such so as to avoid interference or jamming against the abutment 12 as are the various ornaments suspended from the hook 70*c*. However, it has been found that a thicker body and to some extent thicker ornaments are accommodated if the face 42*c* of the device 10*c* is shaped in a unique fashion. Thus by incorporating a forwardly projecting element 90 such as the nose 92 which includes a central peak 94 and a pair of ramped surfaces 96 on either side of the peak, larger dimensioned bodies 40*c* and ornaments 74*c* can be accommodated and/or greater assurance of avoiding jamming between the device 10*c* and the abutment 12 assured.

Thus as shown in FIG. 10, the face 42*c* of the body 40*c* includes ramps 96 gradually forwardly projecting from the body main surface 98 to the peak 94 depicted in the shape of a nose, although it should be apparent that the peak and ramps can be part of any other bas-relief design or simply be an outwardly directed triangular or wedge shaped structure which may not even be centered (the ramps could be separated, that is, partial ramps laterally provided in separated relationship on the face 42*c*) and not necessarily part of any design. Thus as the screen 16 is laterally moved towards the abutment 12, the proximate ramp 96 gradually contacts and rides up the abutment so as to avoid jamming and, if necessary, such as in those cases where the body thickness is slightly greater than the clearance S, will rearwardly bow the screen to the dotted line showing so as to enable the screen 16 to pass. When the screen 16 moves in the opposite direction, contact with the other ramp accomplishes the same action. Also when the ornament 74*c* is also oversized (over thick) and contacts the abutment 12 prior to contact with the proximate or leading ramp 96, then the ornament is free to swing to the depicted dotted line position about the hook 72*c* until that point that the ramp action forces the screen rearwardly and thus provide the necessary clearance to pass. Obviously, the screen should be moved slowly when utilizing this feature and with regard to passage of oversized ornaments, it is desirable that a hook configuration which does not outwardly extend as described with reference to FIG. 4A be utilized.

It is thus apparent that a device in various modified forms has been presented by the present invention which accomplishes the overall objectives in a simple, low cost and re-usable manner. It should also be pointed out that while the present invention has been described particularly in relationship to a sliding screen door, it should also be brought out that it has equal utility with other types of screen structures. While with such other screen structures, it is unlikely that one of the primary purposes of alerting a user to a potential danger of walking through a screen is not as apparent, the ornamental function still remains.

While there is shown and described herein certain specific structure embodying this invention, it will be manifest to those skilled in the art that various modifications and rearrangements of the parts may be made without departing from the spirit and scope of the underlying inventive concept and that the same is not limited to the particular forms herein shown and described except insofar as indicated by the scope of the appended claims.

What is claimed is:

1. In combination with a glass and sliding screen door assembly including a frame having a track for sliding receipt of a sliding door having a screen of the type having a plurality of mesh-like openings, wherein said glass door is spaced from the mesh of the screen door by a finite substantially narrow space, a device for attachment to the screen, said device including a generally centrally disposed, non-mesh, generally solid body having opposed front and rear faces, means for attaching said device to the screen comprising at least one arm attached to said body, said arm upwardly extending from said body, said arm upwardly terminating in a rearwardly extending finger for extension through an opening of the screen, said device further having at least one leg attached to said body and downwardly extending from said body, said leg terminating in a foot for contacting the screen to stabilize said body on the screen and an ornament supporting support connected to and downwardly extending from said body, said support terminating in a forwardly extending terminal hook for supporting an ornament from said body and said device of an overall thickness less than the finite space between the screen and the fixed glass door.

2. The device of claim 1, the front face of said body including ramp means forwardly projecting from said front face whereby lateral movement of the screen door progressively engages said ramp means.

3. The device of claim 2, said ramp means being a pair of ramps laterally inwardly and outwardly extending to a central peak.

4. In combination, a generally planar screen having a forward face and an opposed rearward face and having a plurality of mesh-like openings and a device for attachment to said screen, said device including a generally centrally disposed, non-mesh, generally solid body having opposed front and rear faces, means for attaching said device to said screen comprising at least one arm attached to said body and upwardly extending from said body, said arm upwardly terminating in a rearwardly extending finger adapted for extension through an opening of said screen, said device further having at least one leg attached to said body and downwardly extending from said body, said leg terminating in a foot for contacting said screen to stabilize said body on said screen and an ornament supporting support connected to and downwardly extending from said body, said support terminating in a forwardly extending terminal hook for supporting an ornament from said body said at least one arm and said at least one leg cooperatively spacing said body rear face forwardly of said screen forward face, there being a plurality of arms each upwardly outwardly extending from said body and terminating in fingers which are laterally spaced to either side of said body and a plurality of legs downwardly outwardly extending from said body, each of said feet contacting said screen face at laterally spaced points.

5. The device of claim 4, both said at least one arm and said at least one leg rearwardly extending from said body.

6. The device of claim 5, each of said arms terminating in a finger adapted to extend into the open mesh of said screen, said fingers laterally spaced from each other and said body.

7. The device of claim 4, said feet including toes rearwardly extending and adapted to extend into the open mesh of said screen.

8. The device of claim 4, said body rear face and said arm and said leg in substantial contact with said screen.

* * * * *